US005687493A

United States Patent [19]

Czerner et al.

[11] Patent Number: 5,687,493

[45] Date of Patent: Nov. 18, 1997

[54] COMBINED RETAINING MEMBER FOR AN ELECTRIC APPLIANCE

[75] Inventors: Peter A. Czerner, Trumbull; George M. Drizos, Cheshire, both of Conn.

[73] Assignee: Black & Decker Inc., Newark, Del.

[21] Appl. No.: 583,910

[22] Filed: Jan. 11, 1996

[51] Int. Cl.[6] ..... D06F 75/26; D06F 75/28

[52] U.S. Cl. ..... 38/88; 219/256

[58] Field of Search ..... 38/88, 77.7, 82, 38/94, 96; 219/256, 259, 533; 174/86, 87, 73.1, 84 R; 439/372, 445, 446, 449, 456

[56] References Cited

U.S. PATENT DOCUMENTS

| | | | |
|---|---|---|---|
| 1,650,014 | 11/1927 | Goldrick . | |
| 1,961,013 | 5/1934 | Saraceno | 173/332 |
| 2,512,062 | 6/1950 | Huffman | 219/25 |
| 2,530,540 | 11/1950 | Reichold et al. | 173/322 |
| 2,540,575 | 2/1951 | Finizie | 173/332 |
| 2,597,700 | 5/1952 | Beach | 219/25 |
| 2,911,607 | 11/1959 | Booth | 339/7 |
| 3,022,096 | 2/1962 | Schwartz | 285/164 |
| 3,171,704 | 3/1965 | Meile | 339/75 |
| 3,617,985 | 11/1971 | Kehl | 339/92 M |
| 4,036,543 | 7/1977 | Taketomi | 339/2 R |
| 4,347,428 | 8/1982 | Conrad et al. | 38/82 X |
| 4,357,519 | 11/1982 | Bain, Jr. | 219/256 |
| 4,651,453 | 3/1987 | Doyle | 38/77.8 |
| 4,748,755 | 6/1988 | Bain, Jr. et al. | 38/82 X |
| 4,815,224 | 3/1989 | Miller | 38/90 |
| 4,959,021 | 9/1990 | Byrne | 439/446 X |
| 4,978,306 | 12/1990 | Robb | 439/8 |
| 5,367,799 | 11/1994 | Wilson et al. | 38/77.7 |
| 5,371,960 | 12/1994 | Wilson et al. | 38/77.3 |
| 5,380,219 | 1/1995 | Klier | 439/446 |
| 5,390,433 | 2/1995 | Brady | 38/79 |

FOREIGN PATENT DOCUMENTS

| | | | |
|---|---|---|---|
| 2313492 | 4/1977 | France | 219/256 |
| 41999 | 3/1985 | Japan | 219/256 |
| 3021299 | 1/1991 | Japan | 219/256 |

*Primary Examiner*—Ismael Izaguirre
*Attorney, Agent, or Firm*—Barry E. Deutsch

[57] ABSTRACT

A steam iron having a soleplate, a housing, an electric cord extending into the housing through a bushing pivotably mounted to the housing, and a retaining member mounted to the housing. The retaining member has a first section with a snap-off rib that forms a strain relief with the housing for the electric cord. The retaining member also has a second section with a curved portion that forms part of the pivotable connection of the electric cord bushing to the housing. A third section of the retaining member is a cantilevered arm that holds an electronic module against the housing.

17 Claims, 3 Drawing Sheets

COMBINED RETAINING MEMBER FOR AN ELECTRIC APPLIANCE

BACKGROUND OF THE INVENTION

1. Field of the Invention

The present invention relates to electric appliances and, more particularly, to a retaining member that provides multiple retaining functions.

2. Prior Art

U.S. Pat. No. 4,357,519 discloses an electric steam iron with a handle and a rear cover that pivotably captures an electric cord bushing. The conductors are retained with a strain relief and a bolt attached against the housing. U.S. Pat. No. 5,367,799 discloses a cord grommet pivotably attached to a rear cover at cradles. U.S. Pat. No. 4,651,453 discloses an iron having a resistor assembly attached to a housing.

SUMMARY OF THE INVENTION

In accordance with one embodiment of the present invention a retaining member for an electric iron is provided comprising three sections. A first section is for attachment to a housing of the iron. The first section has a strain relief section for contacting an electric cord. A second section extends from the first section and has a curved portion that forms part of a pivotable connection point of a bushing for the electric cord into the housing. A third section extends from the first section for holding an electronic module between the third section and the housing.

In accordance with another embodiment of the present invention in an electric appliance having a housing, an electronic module, and an electric cord extending into the housing, the improvement comprises a one-piece retaining member connected to the housing. The retaining member has a cantilevered arm holding the electronic module against the housing and a section that holds a portion of the electric cord in a sandwiched position between the housing and the retaining member to function as a strain relief connection for the portion of the electric cord.

In accordance with another embodiment of the present invention in an electric appliance having a housing and an electric cord extending into the housing through an electric cord bushing pivotably connected to the housing, the improvement comprises a mounting member connected to the housing and forming a portion of an electric cord strain relief and a portion of the electric cord bushing mount. The mounting member comprises a first section that presses a portion of the electric cord against the housing to thereby stationarily connect the portion to the housing and a second section with a curved portion. The curved portion captures pivot points of the bushing against the housing such that the bushing can pivot at the curved portion but is otherwise fixedly attached to the housing.

In accordance with another embodiment of the present invention in an electric appliance having a housing, an electronic module, and an electric cord extending into the housing through an electric cord bushing pivotably mounted to the housing, the improvement comprises a mounting member connected to the housing having a section that holds the electronic module in a stationary position against the housing and a curved portion that captures pivots of the electric cord bushing against the housing to thereby pivotably mount the bushing to the housing.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
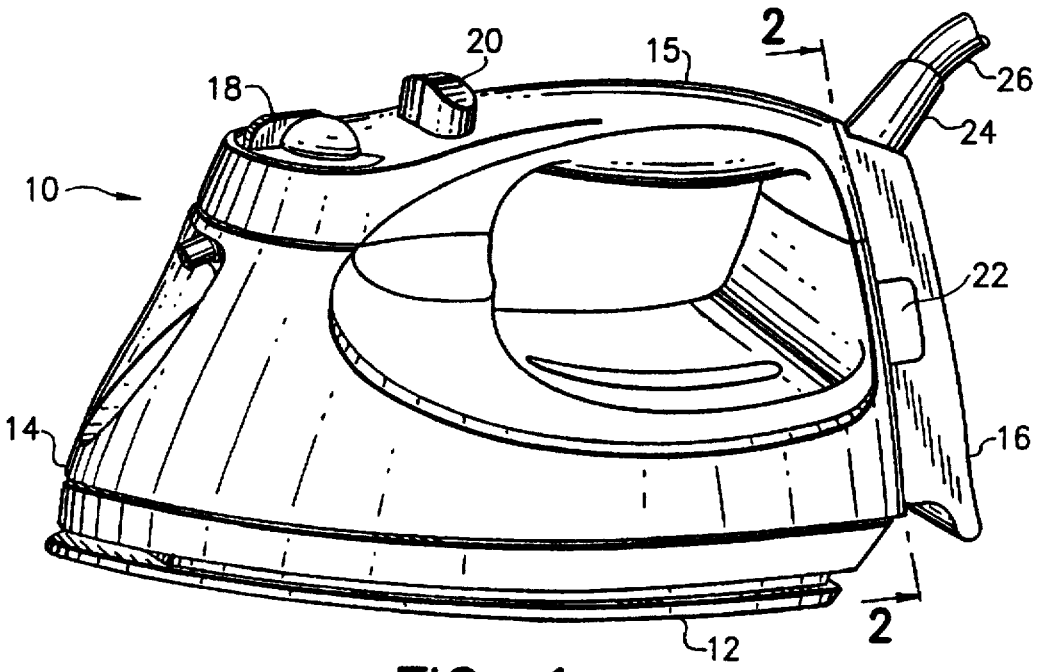
FIG. 1 is a perspective view of an electric steam iron incorporating features of the present invention.

Referring to FIG. 1 there is shown a perspective view of an electric steam iron 10 incorporating features of the present invention. Although the present invention will be described with reference to the single embodiment shown in the drawings, it should be understood that features of the present invention can be embodied in many alternative forms of alternate embodiments. In addition, any suitable size, shape, or type of elements or materials could be used.

Figure 2:
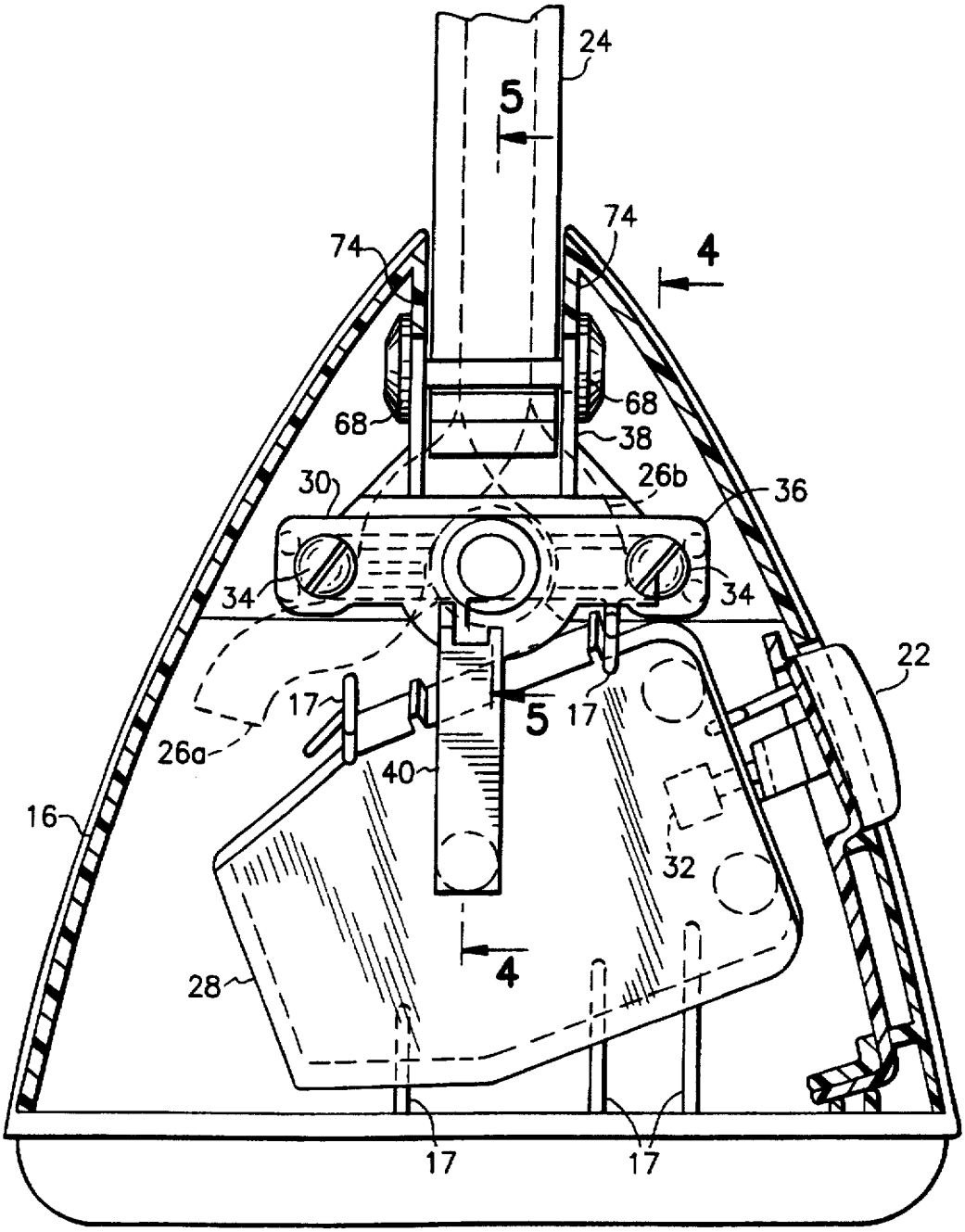
FIG. 2 is a cross-sectional view of the iron shown in FIG. 1 taken along line 2—2.

The iron 10 generally comprises a soleplate 12, a housing 14 with a rear cover 16, a control knob 18, a steam surge button 20, a reset button 22, an electric cord bushing 24 and an electric cord 26. However, features of the present invention could be incorporated into other types of irons and other types of electrical appliances. Referring also to FIG. 2, the rear cover 16 has the reset button 22 attached to it and houses an electronic module 28 and a retaining member 30. In the embodiment shown, the module 28 is an auto-OFF module that has circuitry adapted to automatically turn the iron 10 OFF after a predetermined period of time, such as one hour. The reset button 22 is adapted to depress an actuator 32 of the module 28 to reset the module. However, in alternate embodiments, any suitable type of electronic module could be used.

Figure 3:
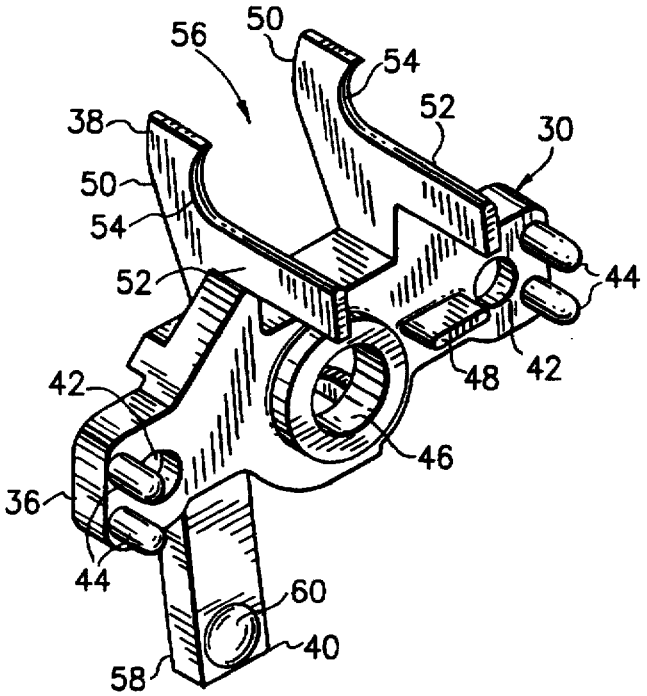
FIG. 3 is a top, rear and side perspective view of the retaining member shown in FIG. 2.

The retaining member 30, in the embodiment shown, is a one-piece plastic or polymer member that is attached to the rear cover 16 by two screws 34. However, in alternate embodiments, other types of fasteners or attachment means could be used. Referring also to FIG. 3, the retaining member 30 has a first middle section 36, a second top section 38 and a third bottom section 40. References to top and bottom are made for description purposes only. The first section 36 includes two lateral holes 42, locating ribs 44, a center hole 46, and strain relief rib 48. The second section 38 extends from the top of the first section 36 and includes two top cantilevered arms 50. The top arms 50 each have a stabilizing section 52 and a curved section 54. An open space or gap 56 is provided between the two top arms 50. The third section 40 extends from the bottom of the first section 36 and includes a cantilevered bottom arm 58. The distal end of the bottom arm 58 has a protrusion 60. The bottom arm 58 also has an offset step 62 (see FIG. 4) and is angled relative to the first section 36.

Figure 4:
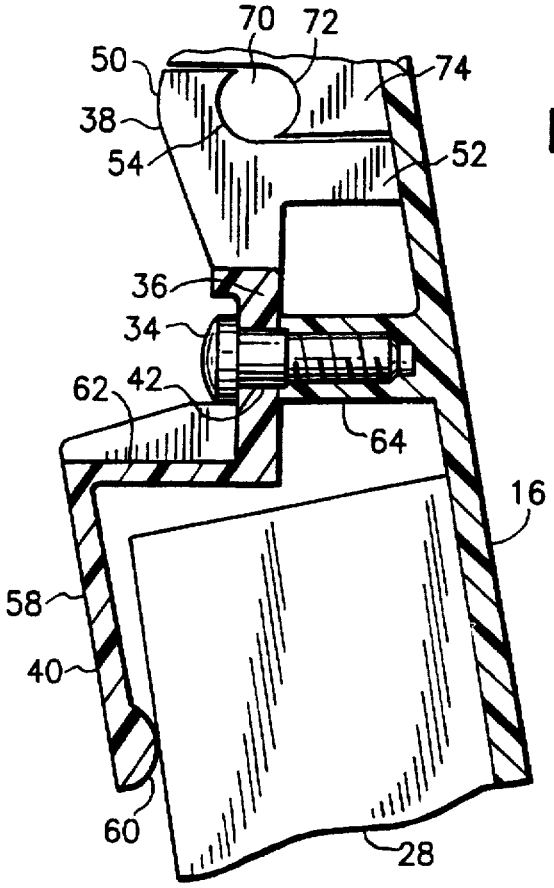
FIG. 4 is a partial schematic cross-sectional view of the iron shown in FIG. 2 taken along line 4—4.

Referring to FIGS. 2 and 4, the screws 34 pass through the holes 42 and are received in screw bosses 64 (only one of which is shown) of the rear cover 16. The locating ribs 44 help guide the retaining member 30 onto the bosses 64 such that the holes 42 are aligned with the screw holes in the bosses 64. The center hole 46 is provided to allow passage of a boss (not shown) of the handle 15 (see FIG. 1) such that the handle 15 can be directly connected to the rear cover 16. The rear end of the stabilizing sections 52 of the top arms 50 rest against the rear cover 16. The bottom arm 58 captures or sandwichs the electronic module 28 between the arm 58 and the rear cover 16 to thereby physically attach the module 28 to the rear cover 16. In a preferred embodiment the bottom arm 58 is deflectable and is spring loaded against the module 28. Ribs 17 of the cover 16 help to keep the module 28 stationarily locked in place.

Figure 5:
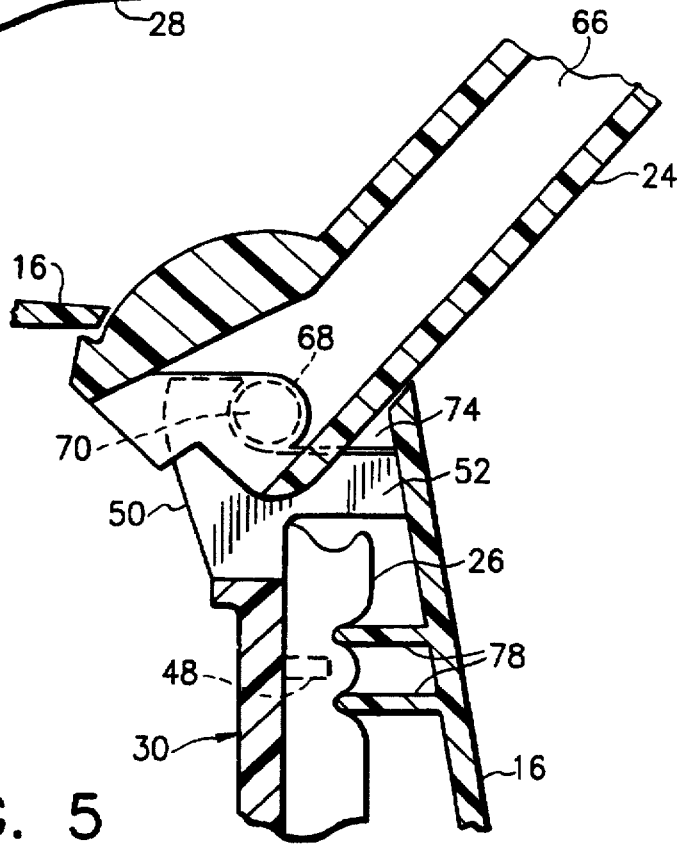
FIG. 5 is a partial schematic cross-sectional view of the iron shown in FIG. 2 taken along line 5—5.

Referring also to FIG. 5, the bushing 24 includes a center channel 66 and two pivots 68 (see FIG. 2). The electric cord 26 passes through the center channel 66 into the housing 14. The pivots 68 are received in pivot points 70 (see FIG. 4) formed between the curved sections 54 of the top arms 50 and curved sections 72 of cooperating ribs 74 on the rear cover 16. This pivotably mounts the bushing 24 to the rear cover 16 by capturing the pivots 68 between the curved sections 54, 72.

As seen in FIG. 2, when the electric cord 26 exits the bottom of the bushing 24, it branches into two sections 26*a*, 26*b* on opposite sides of the center hole 46 and between the retaining member 30 and the rear cover 16. As seen in FIG. 5, the rear cover 16 has strain relief ribs 78. The retaining member 30 presses the cord section 26*a* against the ribs 78. In addition, the strain relief rib 48 on the retaining member 30 is positioned opposite the ribs 78 to further press the cord section 26*a* against the ribs 78. This forms a fixed attachment of the cord section 26*a* to the rear cover 16 and, thus, forms a strain relief for the cord 26. The rib 48 is adapted to be snapped off of the retaining member 30 when the cord 26 is a 220 volt electrical cord. However, the rib 48 is retained for use with a thinner 110 volt electrical cord.

The retaining member 30, in cooperation with the rear cover 16, is able to provide three different retaining functions. It is able to retain the module 28 with the rear cover 16. It is able to pivotably retain the electric cord bushing 24 with the cover 16. It is able to provide strain relief retainment of the electric cord 26 with the rear cover 16. These three functions are provided by only four parts; the rear cover 16, the retaining member 30 and the two screws 34. This reduces the number of parts in the iron that would otherwise be needed. The method of assembly merely comprises properly positioning the components and attaching the two screws 34 to the rear cover 16.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A unitary retaining member for an electric iron comprising:

a first section for attachment to a housing of the iron, the first section having a strain relief section for contacting an electric cord;

a second section extending from the first section having a curved portion that forms part of a pivotable connection point of a bushing for the electric cord into the housing; and a third section extending from the first section for holding an electronic module between the third section and the housing.

2. A retaining member as in claim 1 wherein the retaining member is a one-piece member.

3. A retaining member as in claim 1 wherein the first section is located between the second and third sections.

4. A retaining member as in claim 1 wherein the strain relief section comprises a snap-off rib that is removed from the first section when the cord is a 220 volt electric cord.

5. A retaining member as in claim 1 wherein the second section comprises two spaced curved portions.

6. A retaining member as in claim 1 wherein the third section is a deflectable cantilevered arm.

7. In an electric appliance having a housing, an electronic module, and an electric cord extending into the housing, wherein the improvement comprises:

a one-piece retaining member connected to the housing, the retaining member having a cantilevered arm holding the electronic module against the housing and a section that holds a portion of the electric cord in a sandwiched position between the housing and the retaining member to function as a strain relief connection for the portion of the electric cord.

8. An appliance as in claim 7 wherein the appliance is an electric steam iron with a soleplate.

9. An appliance as in claim 7 wherein the section that holds a portion of the electric cord in a sandwiched position comprises a snap-off rib.

10. An appliance as in claim 7 wherein the retaining member further comprises a curved portion that forms part of a pivotable connection of a bushing for the electric cord into the housing.

11. In an electric appliance having a housing, and a rear cover and an electric cord extending into the housing through an electric cord bushing pivotably mounted to the cover, wherein the improvement comprises:

unitary mounting member separate from and, connected to housing and the cover and having a first section forming a portion of an electric cord strain relief and a second section forming a portion of an electric cord bushing mount, the first section pressing a portion of the electric cord against the housing to thereby stationarily connect the portion to the housing and said second section having a curved portion that captures pivot points of the bushing against the cover such that the bushing can pivot at the curved portion but is otherwise fixedly attached to the cover.

12. An appliance as in claim 11 wherein the appliance is an electric steam iron with a soleplate.

13. An appliance as in claim 12 wherein the mounting member is connected to a rear cover of the housing.

14. An appliance as in claim 11 wherein the first section has a snap-off rib that contacts the portion of the electric cord.

15. An appliance as in claim 11 further comprising a cantilevered arm holding an electric module against the housing.

16. An appliance as in claim 11 wherein the mounting member is a one-piece member.

17. In an electric appliance having a housing, a cover connected to the housing, an electronic module, and an electric cord extending into the housing through an electric cord bushing pivotably mounted to the cover, wherein the improvement comprises:

a unitary mounting member separate from and connected to the housing and to the cover and having a section that holds the electronic module in a stationary position against the housing and a curved portion that captures pivots of the electric cord bushing against the cover thereby pivotably mount the bushing to the cover.

* * * * *